US007077298B2

(12) United States Patent
Vlooswijk et al.

(10) Patent No.: US 7,077,298 B2
(45) Date of Patent: Jul. 18, 2006

(54) BEVERAGE CONTAINER PROVIDED WITH A DISPENSING VALVE WITH IMPROVED OPERATING MEANS

(75) Inventors: Johannes Jacobus T. Vlooswijk, Linschoten (NL); Andrew John Reynolds, Huntingdon (GB); Darren Seymour, Huntingdon (GB)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 10/432,676

(22) PCT Filed: Nov. 21, 2001

(86) PCT No.: PCT/NL01/00848

§ 371 (c)(1),
(2), (4) Date: Sep. 29, 2003

(87) PCT Pub. No.: WO02/42197

PCT Pub. Date: May 30, 2002

(65) Prior Publication Data

US 2004/0050879 A1 Mar. 18, 2004

(30) Foreign Application Priority Data

Nov. 23, 2000 (NL) ..... 1016688

(51) Int. Cl.
*B65D 83/00* (2006.01)

(52) U.S. Cl. ..... 222/402.13; 222/402.15; 222/402.24

(58) Field of Classification Search ..... 222/402.1, 222/402.13, 402.15, 402.24, 402.25
See application file for complete search history.

(56) References Cited

U.S. PATENT DOCUMENTS

| | | | | |
|---|---|---|---|---|
| 2,968,441 | A * | 1/1961 | Holcomb | 239/337 |
| 3,143,254 | A * | 8/1964 | Vanderhyde | 222/402.11 |
| 4,671,436 | A | 6/1987 | Hagan | 222/402.25 |
| 4,773,571 | A | 9/1988 | Hagan et al. | 222/394 |
| 4,860,932 | A * | 8/1989 | Nagy | 222/402.1 |
| 5,246,140 | A | 9/1993 | Thix et al. | 222/4 |
| 5,624,055 | A * | 4/1997 | Clanet et al. | 222/135 |
| 6,095,379 | A * | 8/2000 | Martinez et al. | 222/402.13 |

FOREIGN PATENT DOCUMENTS

WO WO 00 35803 6/2000

* cited by examiner

*Primary Examiner*—Joseph A. Kaufman
(74) *Attorney, Agent, or Firm*—Pearne & Gordon LLP

(57) ABSTRACT

Beverage container provided with a dispensing valve (7) and a dispensing channel (31, 33) connected to said dispensing valve, wherein an operating arm (41) is provided which, in a position of rest, includes an angle with a plane at right angles to a longitudinal axis (L) of the dispensing valve, wherein a pressure body (19) is provided between the pivoting arm and the valve, such that upon a pivotal movement of the arm from the position of rest the pressure body is moved and the valve is opened by the pressure body.

20 Claims, 7 Drawing Sheets

BEVERAGE CONTAINER PROVIDED WITH A DISPENSING VALVE WITH IMPROVED OPERATING MEANS

BACKGROUND OF THE INVENTION

This application was published in English on May 30, 2002 as International Publication Number WO 02/42197 A1.

FIELD OF THE INVENTION

The invention relates to a beverage container, provided with a dispensing valve as described in NL 1012802.

This known beverage container is provided in the top surface with a dispensing valve, in particular an aerosol valve, through which beverage can be dispensed from the container by pushing the stem of the valve downwards, in the direction of the inner space of the container. To that end, on the valve, a knob is provided, on which a tube element is provided extending beyond the outermost peripheral edge of the top surface of the container, and through which a dispensing channel extends. This dispensing channel terminates in the hollow inner side of the stem of the valve, so that, with an opened valve, a fluid communication is obtained between the inner space of the container and the free end of the dispensing channel mentioned.

With this beverage container, for operating the dispensing valve, the knob has to be moved vertically, in the direction of the top surface. This is a disadvantageous operating direction, while, moreover, the distance over which the knob has to be moved is necessarily equal to the movement necessary for opening the dispensing valve. This results in a relatively small movement.

SUMMARY OF THE INVENTION

The invention contemplates a beverage container of the type described in the preamble, wherein improved operating means are provided for operating the dispensing valve. To that end, a beverage container according to the invention is characterized by the features herein.

By using an operating arm which, in a position of rest, includes an angle with a plane at right angles to the longitudinal axis of the dispensing valve, an operating means is obtained which is visually attractive and, at least in the position of rest, is well visible, while, for tapping beverage from the container, a pleasant tapping sensation can be obtained, comparable to that of a tapping device in a bar, restaurant, et cetera. Furthermore, with a beverage container according to the present invention the advantage is achieved that the direction of movement of the operating arm is a pivoting movement and, therefore, is located in a different plane, at least in a different direction than the direction of movement necessary for opening the dispensing valve. Thus, the direct relation between the distance over which the pivoting arm is pivoted and the movement of the dispense valve is eliminated and can be selected as desired. Furthermore, by selecting the length of the pivoting arm and the transmission between the pivoting arm and the pressure body a suitable operating force can simply be selected, depending on the desired tapping sensation. As a result, the operating force is no longer, at least to a far lesser extent, dependent on the operating force necessary for opening and closing the valve.

In an advantageous embodiment, in the position of rest, the pivoting arm includes an angle with the above-mentioned plane, at right angles to the longitudinal axis of the dispensing valve between 45 and 135°. Thus, sufficient space between the pivoting arm and the plane of the container in which the valve has been provided is kept clear for movement of the pivoting arm, while, furthermore, from a side of the container, the pivoting arm is well visible and accessible. Here, it is preferred that the pivoting arm, in position of rest, extends approximately vertically, at least at right angles to the plane mentioned. In this manner, the accessibility, visibility and operation are further improved.

In a further advantageous embodiment, a beverage container according to the invention is further characterized by the features herein.

With such an embodiment, pivoting arm and pressure body can be cleaned in a simple manner and, furthermore, the pivoting arm and/or the pressure body can be reused with different containers.

In a further advantageous embodiment, a beverage container according to the invention is further characterized by the features herein.

Surprisingly, it has been found that use of a valve with a stem with a connecting channel having a larger passage surface than the total surface of the or each passage opening through which beverage is to enter into this connecting channel, leads to a particularly advantageous tapping behaviour. Here, it has been found that it is preferred that a relatively small number of passage openings be provided, for instance two to four passage openings, while two passage openings lead to particularly good results.

Here, it is preferred that in the flow path for the beverage, no relatively sharp bends are provided, other than in or adjacent the dispensing valve. In particular the dispensing channel is preferably designed such that only gentle bends, i.e. bends with a relatively large bending radius are included therein, so that undesired turbulent flows and foam formation are prevented.

In a further embodiment, a beverage container according to the invention is further characterized by the features herein.

Through a proper dimensioning of the riser, the valve and the dispensing channel, relatively simply a desired pressure drop between 0.4 and 1.5 bar can be obtained between the inner space of the container and the surroundings. Preferably, the dimensioning is such that during use, this pressure drop is approximately 0.7 bar. This means that the beverage can be stored in the container with the desired excess pressure, for instance approximately 0.7 bar, which, in particular when using the container for storing and dispensing beer, will lead to a desired equilibrium pressure of $CO_2$. By additionally providing that a large part and preferably at least half of the pressure drop occurs across the valve, a still better tapping behaviour is obtained. It is preferred that the pressure drop over the dispensing channel after the valve is relatively small, for instance approximately 0.2 bar or less, so that undesired foam formation is still better prevented.

The invention further relates to a dispensing device for use with a beverage container according to the invention, characterized by the features herein.

In the further claims, further advantageous embodiments of a beverage container and dispensing device according to the invention are shown.

In elucidation of the invention, exemplary embodiments of a beverage container according to the invention and a dispensing device to be used therewith will be described further with reference to the drawing.

DETAILED DESCRIPTION OF THE PREFERRED EMBODIMENTS OF THE INVENTION

Figure 1:
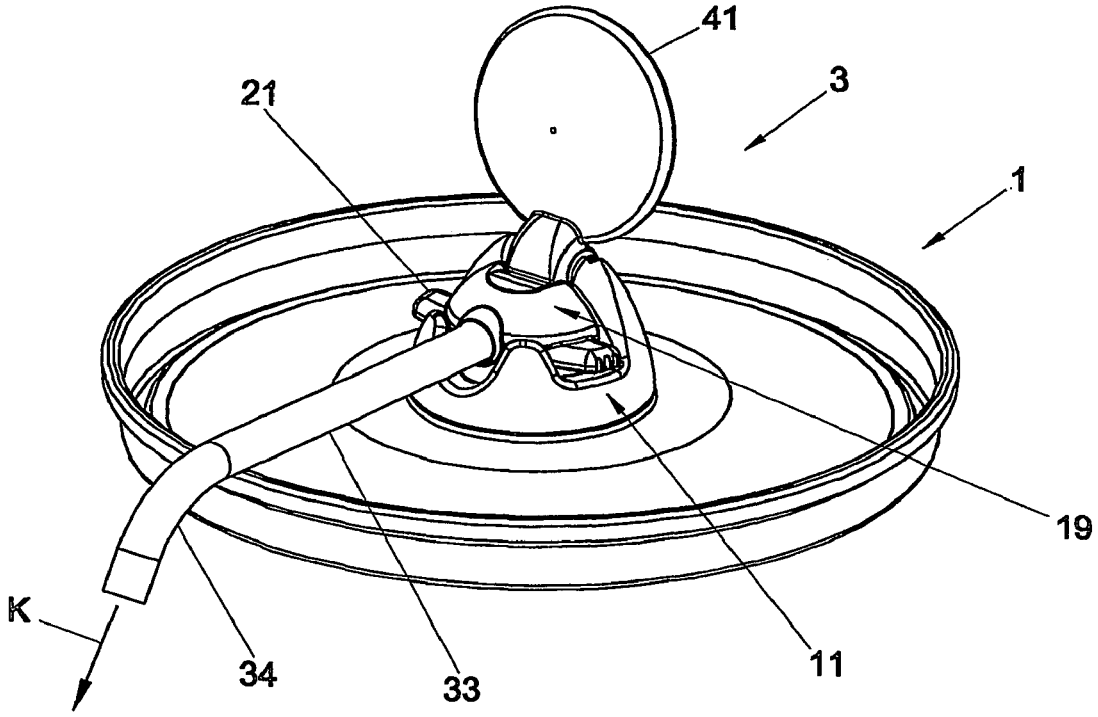
FIG. 1 shows, in perspective top plan view, a lid for a beverage container with a dispensing device according to the invention.

In this description, identical or corresponding parts have identical or corresponding reference numerals.

For a more detailed description of a beverage container with a dispensing valve, in particular suitable for the present invention, reference is made to the Dutch patent application NL 1012802, which description is understood to be incorporated herein by reference. It is noted that also other beverage containers are suitable for use within the present invention, for instance beverage containers which are provided with or can be connected to sources for a pressure gas located outside the container.

In this description, identical or corresponding parts have identical or corresponding reference numerals. In the embodiments shown, each time, a dispensing valve of the female type is described. However, it will be clear that in the same or comparable manner, a dispensing valve of the male type or a tilting valve can be used.

Figure 5:
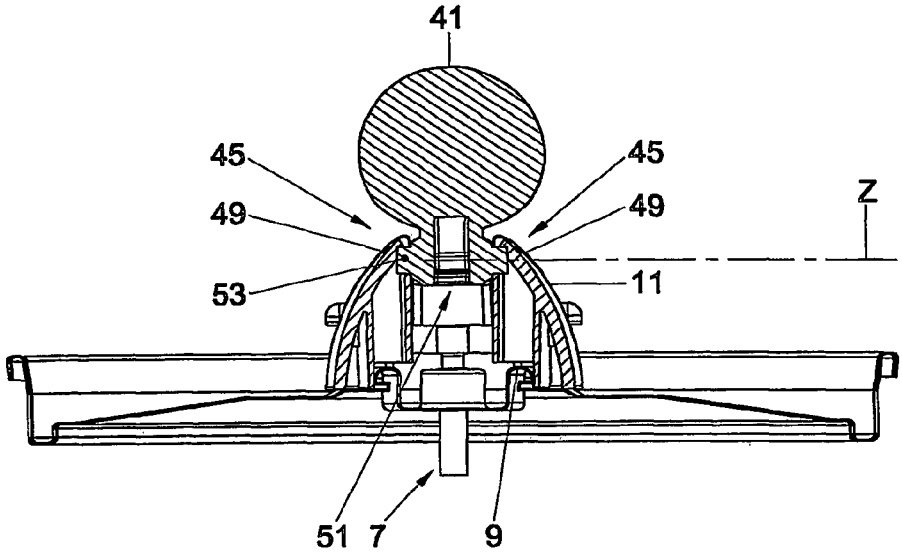
FIG. 5 shows, in cross sectional view along the line V—V of FIG. 4, a lid for a container according to the invention.

FIG. 1 shows, in perspective view, a lid 1 for a beverage container 2 with a dispensing device 3 according to the invention. The lid 1 is a lid known per se, pressed from plate material, in particular tin, with a flange 4 which can be secured over an upper peripheral edge of a, for instance, deep or thin drawn metal container 2. Naturally, lid and container can also be formed in a different manner and from different materials. The upper peripheral edge 5 of the lid 1 defines a plane V which, in normal use of the container in the embodiment shown, extends horizontally, at right angles to the longitudinal axis L of the container 2. Centrally in the lid 1, as is clear, for instance, from FIG. 5, a valve 7 has been secured in a central opening, with a folding technique known per se. As a result, a flange 9 is created, under which a housing 11 of the dispensing device 3 is secured, for instance with the aid of snap fingers 13, so that the housing 11, and, hence, the dispensing device 3, is detachable from the lid 2 and the valve 7.

Figure 2:
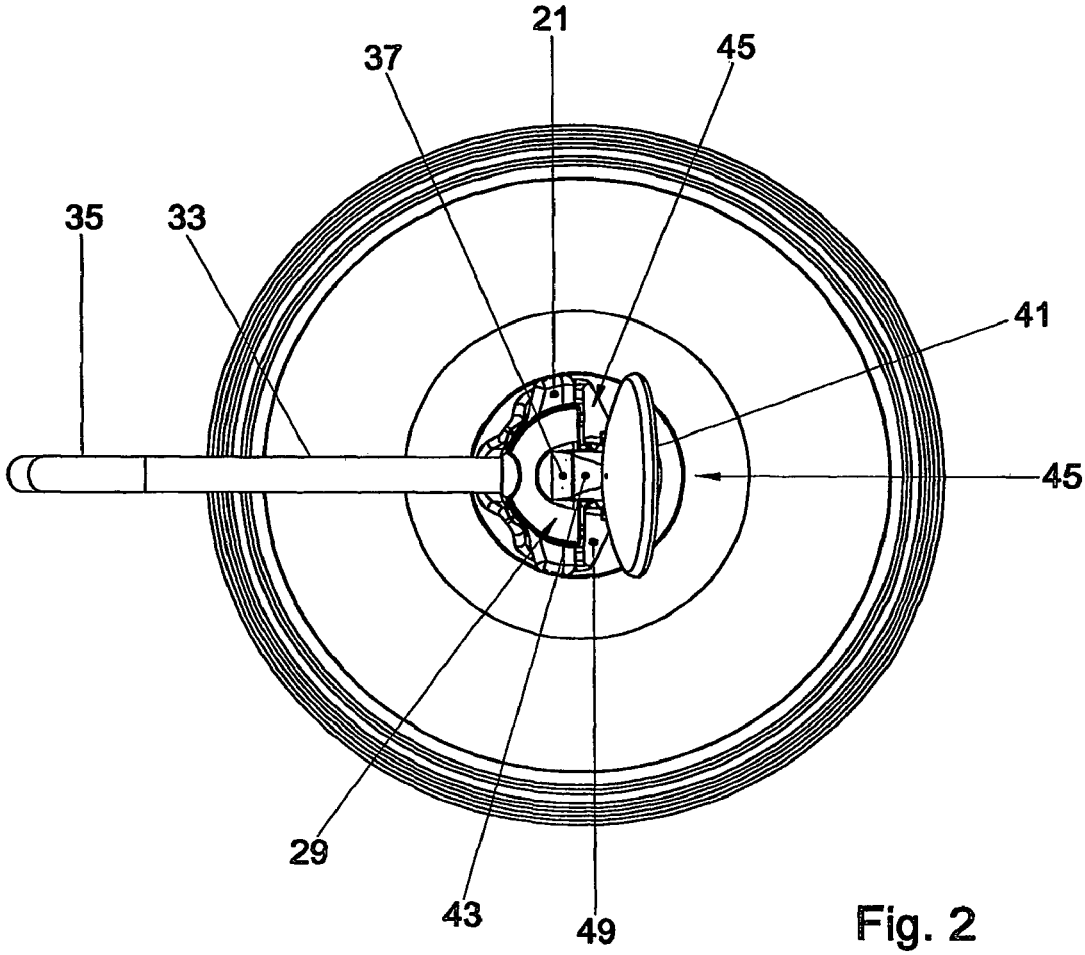
FIG. 2 shows, in top plan view, a container according to the invention, provided with a lid according to FIG. 1.
Figure 2A:
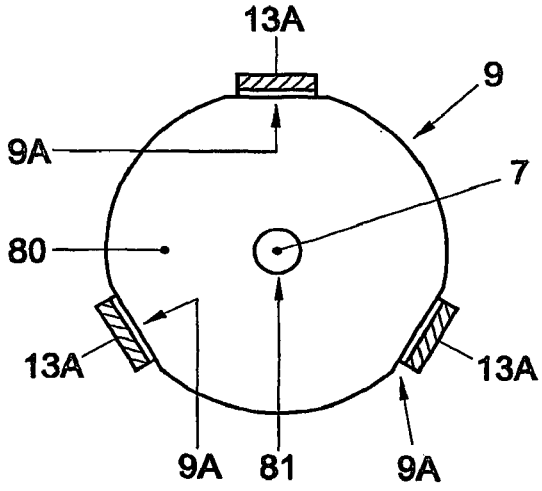
FIG. 2A shows a detail of a lid according to FIG. 1.

FIG. 2A shows, in top plan view, the valve 7 with the flange 9 provided therearound, together with, schematically, the lower ends 13A of the snap fingers 13. In top plan view, the flange 9 is provided with a number of flattened parts 9A, preferably a number corresponding to the number of fingers 13, for instance 3, at a regular mutual angle. The housing 11 can simply be pushed over the flange 9, whereupon the fingers 13 engage thereunder. For removing the housing 11, it is rotated, until the fingers 13 are moved with their lower ends 13A against the flattened parts 9A. Surprisingly, it has been found that thus, the housing comes loose from the flange 9.

Figure 6:
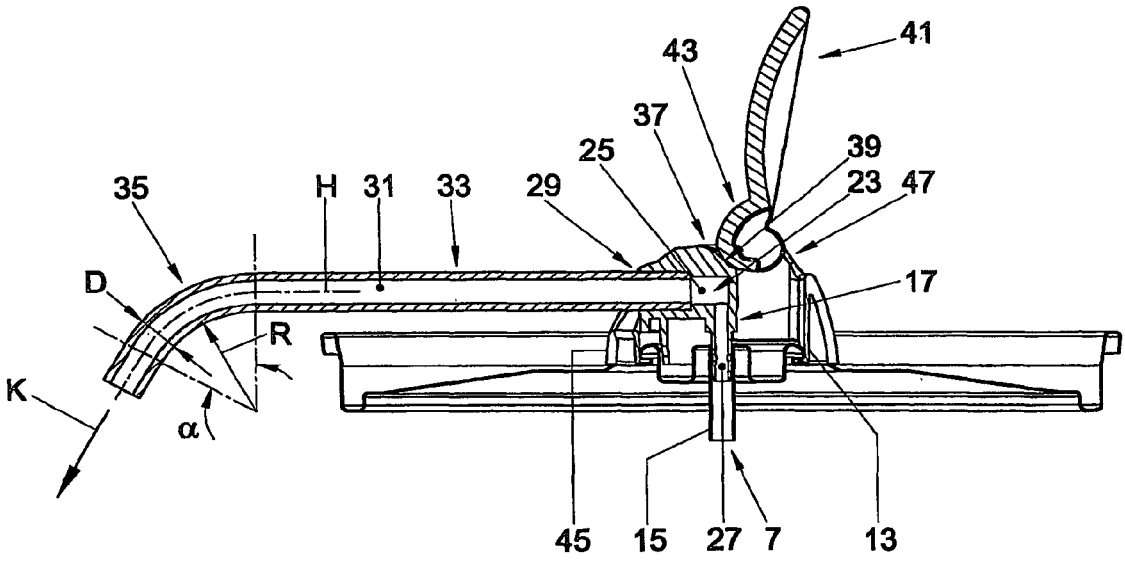
FIG. 6 shows, in cross sectional view along the line VI—VI of FIG. 3, a lid for a container according to the invention.

In the cross section shown in FIG. 6, the valve 7 is represented only as a hollow, cylindrical tube 15 with, having inserted therein, a stem 17 for cooperation therewith. For clarity's sake, customary sealing means of the valve 7 have been omitted. For a better understanding of such a valve, reference is made to Dutch patent application NL 1012802 and the valves described therein, and to the references therein, which are understood to be incorporated herein by reference.

Figure 6A:
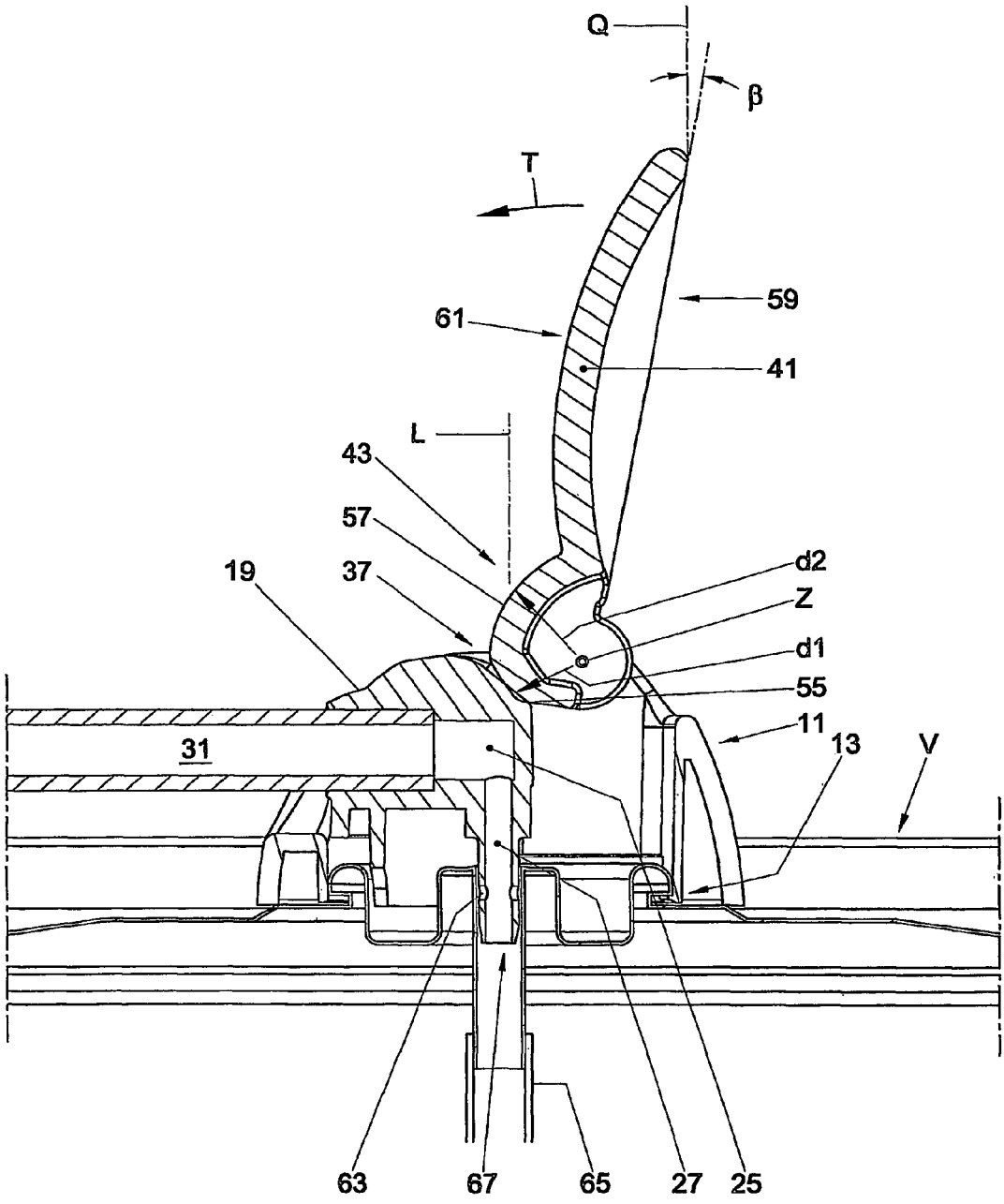
FIG. 6A shows a detail of a lid according to FIG. 6.
Figure 6B:
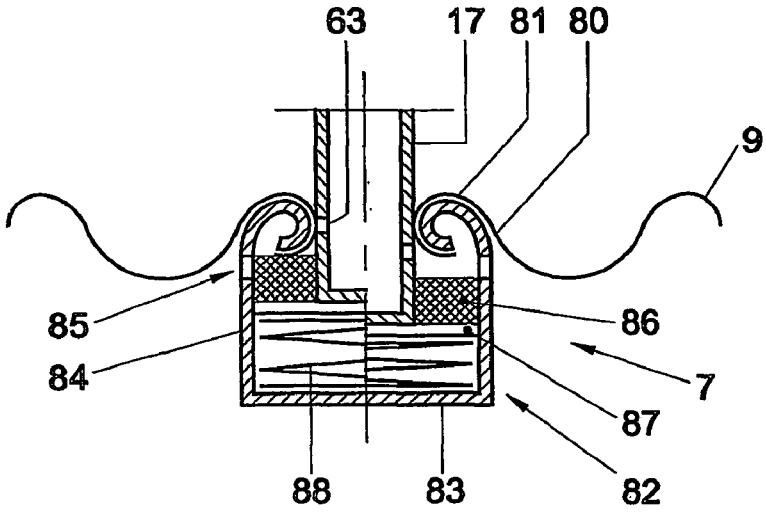
FIGS. 6B and 6C show two embodiments of valves according to the invention.

FIG. 6B schematically shows a female valve 7, secured in a valve housing 80 with the aid of an inwardly rolled flange 81. The female valve 7 comprises a bush 82 with a bottom 83 and a peripheral wall 84 connected at the top to the flange 81. In the peripheral wall 84 a number of passage openings 85 are provided adjacent the upper edge. Within the bush 82, a packing ring 86 is axially movably received, attached to a plate 87 which is biased upwards by a spring 88. When the plate 87 is pushed down, the packing 86 is taken along. The packing 86 is annular and has its the outer edge abutting against the inside of the bush. In the upper position, shown on the left-hand side in FIG. 6B, the openings 85 are closed off by the packing. The stem 17 can be inserted from the top side through the flange edge 81 into the packing 86 and be pushed against the plate 87. Upon axial, downward movement, the stem 17 will push the packing 86 away from the openings 85, while the passage openings 63 in the stem 17 pass under the flange 81. Thus, a fluid communication is obtained between the inner space of the container and the surroundings. The inwardly rolled flange 81 simplifies placing of the stem 17.

Figure 6C:
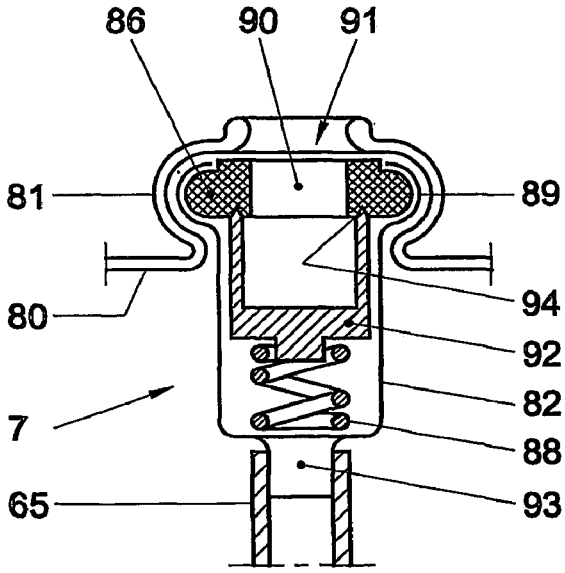

In FIG. 6C, schematically, in cross sectional side view, an alternative embodiment of a female valve 7 is shown, partly in cross section. Here, a cup-shaped bush 82 is provided at the upper edge with a circumferential groove 89, open towards the inside, in which a packing ring 86 is confined. The upper edge of the bush 82 is confined by a flange 81 of the valve housing 80, such that the opening 90 in the packing 86 lies directly under the opening 91 in the valve housing 80. A valve seat 92 is pushed against the lower side of the packing 86 with the aid of a spring 88 confined in the bush 82. At the lower side of the bush 82, a connecting stub 93 is provided onto which the riser 65 is secured. With the upper edge, the valve seat 92 closes off against the packing 86 and is provided with a cavity 94 for receiving the lower end of the stem 17 (not shown). During use, the stem 17 is pushed through the openings 90 and 91 into the valve seat 92, such that the openings 63 in the stem 17 lie above the upper peripheral edge of the valve seat 92, while the lower end of the stem 17 abuts against the bottom of the cavity 94. Upon further downward pushing, the valve seat 92 is moved away from the packing 86, so that the riser 95 enters into fluid communication with the openings 63 and the inner space of the stem 17. When the pressure is taken from the stem 17, the valve 7 is closed again.

The dispensing device 3 comprises a pressure body 19 which is movably received in the housing 11 and comprises the stem 17 which is inserted into the tube 15, at least in a part of the valve 7. Therefore, the pressure body 19 is movable in axial direction of the container 2 for opening and closing the valve in a manner to be described hereinafter. At the outside, the pressure body is provided at two diametrically opposed sides with a wing 21, extending approximately horizontally, with which the pressure body can be guided into the housing 11. In the pressure body 19, a channel 23 is included with a first part 25 extending substantially horizontally and a second part 27 extending approximately vertically at least axially relative to the container 2 through the stem 17. In the exemplary embodiment shown, the first part 25 and the second part 27 link up at an angle of approximately 90 degrees. The second part 27 has a smaller cross section than the first part 25, the cross section of the second part being, for instance, approximately 2 to 3 mm, in particular for instance 2.4 mm, while the cross section of the first part is, for instance, three times the cross section of the second part 27. At the free end 29, the first part 25 widens somewhat, in which widened portion a dispensing channel 31 is secured, in the embodiment shown in the form of a tube 33 with a channel 31 with a passage surface being approximately equal to that of the narrower portion of the first part 25 of the channel 23. As a result, the channel 23 terminates virtually seamlessly and smoothly in the dispensing channel 31. The end 35 of the tube 33 remote from the pressure body 19 is bent through an angle $\alpha$ of, for instance, 60 degrees, with a bending radius R, based on the central axis H of the channel 31, which is considerably larger than the cross section D of the respective channel 31, at least at the bent part. As a result, the outflow direction K of the channel 31 is directed downwards and in a direction somewhat away from the container 2. The tube 33 is preferably fixedly connected to the pressure body 19 and can optionally be formed in one piece therewith. Therefore, the tube 33, upon an axial movement of the pressure body 19, moves along with it. On the top surface 37 of the pressure body 19, at the side remote from the tube 33, an inclining surface 39 is provided, against which abuts a part of the pivoting arm 31 to be described hereinafter.

The housing 11 comprises an annual part 45 having, at the side of the tube 33, a relatively low height, while at the side remote therefrom, it has a height such that the upper edge 45 forms a shoulder 49 on opposite sides of the slot-shaped recess 47. At a lower end, the pivoting arm 41 is provided with two shaft ends 53 extending on opposite sides of a foot part 51, which shaft ends are confined under the shoulders 49 and together define a rotational axis Z for the pivoting arm 41. The lower end 43, directed in the direction of the tube 33, at least the pressure body 19, is substantially convex. FIG. 6A represents, somewhat enlarged, the dispensing device 3, in which the convex art 43 is clearly shown. In the different Figures, the pivoting arm is shown in position of rest, with the pressure body 19 in the upper position and, consequently, the valve 7 closed. Then, the lower part 55 of the foot part 51 abuts against the inclining surface 37 of the pressure body 19, the distance between the contact surface of the bottom part 55 and the inclining part 37 to the pivot axis Z being $D_1$. Somewhat above the lower end 55, the distance from the outer surface 57 of the convex part 43 to the pivot axis Z, which distance is indicated with $D_2$, is greater than the distance $D_1$ mentioned. This means that when the pivoting arm 41 is pivoted about the pivot axis Z in the direction T, i.e. in the direction of the tube 33, the convex surface 43 is moved along the inclining surface 37, whereby, with an increase of the distance between said outer surface 57 and the pivot axis Z, the pressure body 19 is pushed away downwards, i.e. axially along the longitudinal axis L in the direction of the upper surface V. Thus, the valve 7 is opened and the beverage can flow out of the container 2 via the channel 23 and the dispensing channel 31 to the surroundings in the direction K. In the embodiment shown, the convex surface 43 is bent in relation to the pivotal axis Z such, that upon a pivotal movement in the direction T at an angle of, for instance, approximately 15 degrees, a maximum downward movement of the pressure body 19 is obtained, while the pivot axis 41 cannot pivot further. Naturally, the outer surface 57 of the convex part 43 can also be designed such that for a maximum movement of the pressure body 19, a pivotal movement of the pivoting arm 41 through a smaller or, conversely, much larger angle is necessary, or that the pivoting arm 41 has already effected the complete axial movement of the pressure body 19 at a relatively small angle, while the pivoting arm 41 can be moved further, for instance to an approximately horizontal position or further, for instance by pivoting the pivoting arm through an angle of approximately 90 degrees. For the specific embodiment of the pivoting arm 41, at least the curved part 43 and the length of an engaging part 59 fixedly connected thereto and extending, in a position of rest, approximately vertically, at least including a relatively slight angle $\beta$ with a vertical line Q, parallel to the longitudinal axis L, a selection can for instance be made based on a desired tapping sensation. The fact is that sometimes, in tapping devices, it is customary to select a relatively small operating angle of a pivoting arm, while, conversely, in other places, at other moments or with other kinds of beverages, a relative large pivotal movement is selected. These are differences known per se, for instance nationally determined, at least so occurring, which can be simply met by the specific design. Naturally, also the cooperating surfaces 37 and 57 can be designed differently, depending on the desired tapping behaviour.

In the exemplary embodiment shown, the pivoting arm 41 can be pulled backwards in the direction remote from direction T, so that this is completely free from the pressure body 19. Subsequently, the pressure body 19 can be pulled away upwards, free from the tube 15, so that the pressure body 19 with the tube 33 can be cleaned, can be replaced and can be reused. For the same reason, the housing 11 can be pulled free from the container 2 by releasing the snap fingers 13.

Figure 3:
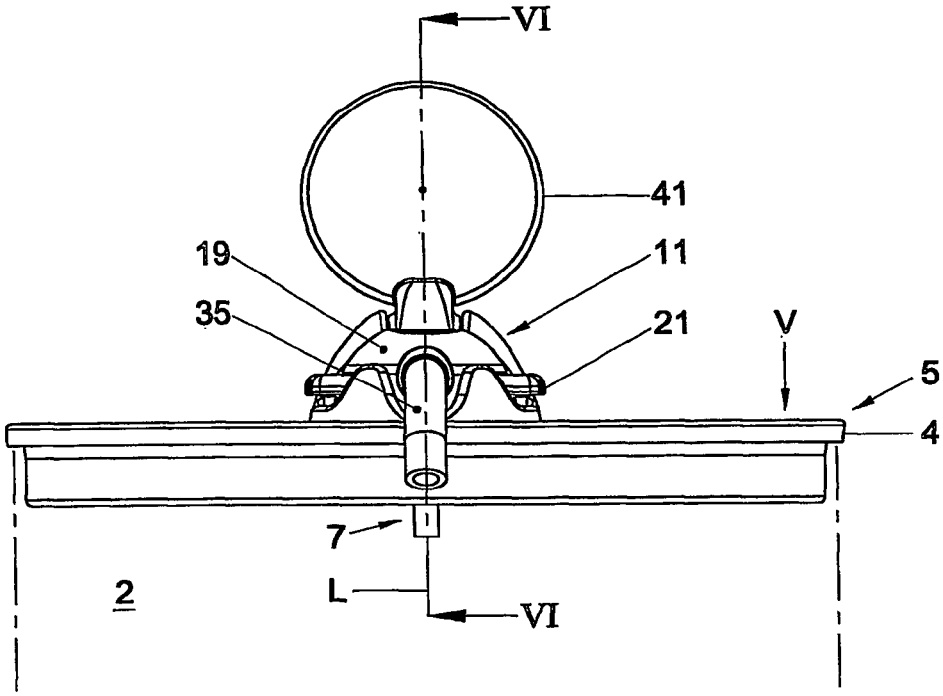
FIG. 3 shows, in front view, a lid according to FIG. 1.
Figure 4:
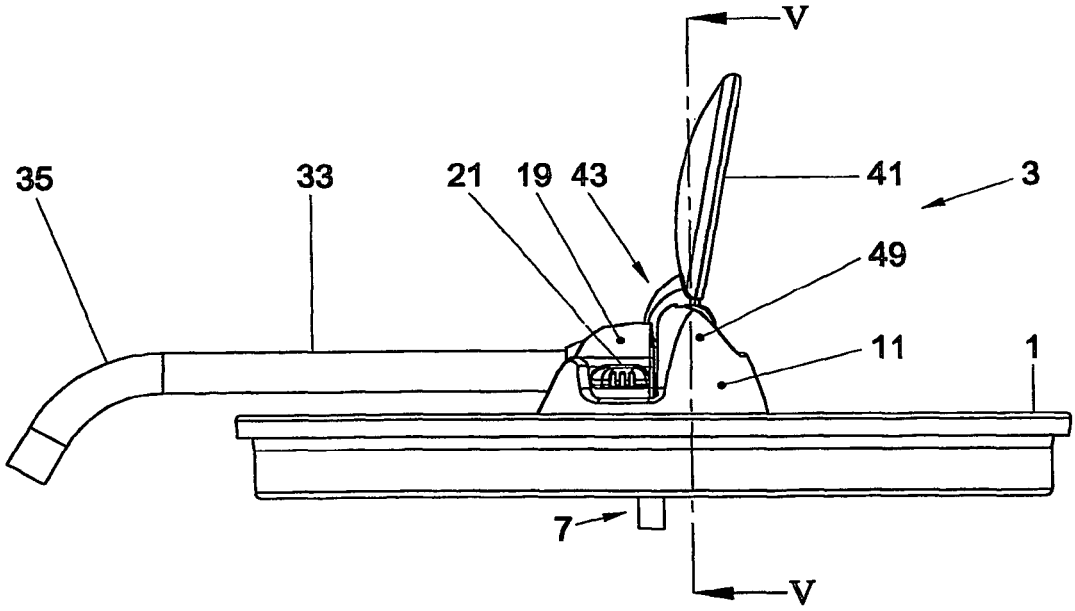
FIG. 4 shows, in side view, a lid according to FIG. 1.

At least at the side proximal to the tube 33 and, therefore, for the user of the tapping device, the most logical set-up side, the engaging part 59 of the pivoting arm 41 has a somewhat convex outer surface 61, the respective part 59 furthermore having, in front view, as shown in for instance FIG. 3, a substantially circular shape. Preferably, on this surface, product identification means have been provided, such as a brand, a logo and the like (not shown)

In the stem 17, a number of passage openings 63 are provided, in the exemplary embodiment shown, two diametrically opposed passage openings. These passage openings have a relatively small passage surface, together smaller than the passage surface of the second part 27 of the channel 23. These openings have, for instance, a diameter between 1 and 2 mm, in particular between 1.4 and 1.6 mm and preferably approximately 1.5 mm. The valve 7 is designed such that with the valve closed, beverage cannot exit into the channel 23, while with the valve 7 opened, beverage can flow from the container, for instance, through a riser 65 (FIG. 6A) connected to the tube 15 and through the passage openings 63 into the second part 27 and thus into the channel 23, while flows of beverage flowing through the passage openings 63 will meet near the middle of the second part 27 and will lead to a relatively large pressure drop. Both with an opened and with a closed valve, the end 67 of the stem 17 remote from the first part 25 is closed, so that no beverage can flow through it into the channel 23. To that end, a closed end surface of the stem can be provided or the valve 7 can be designed such that it prevents beverage entering through the end 67 mentioned.

The riser 65 has a relatively large passage, for instance comparable to that of the dispensing channel 31, so that the greater part of a pressure drop between the free end of the riser 65 and the free end of the dispensing channel 31 occurs substantially across the valve 7, at least across the valve 7 and the stem 17 with the passage openings 63. Surprisingly, it has been found that, in this manner, a particularly good tapping behaviour is obtained. Without wishing to be bound to any theory, it seems this is the result of the fact that foam formation occurring in or near the valve 7 and the stem 17 is at least largely undone in the dispensing channel 31, so that undesired foam formation is prevented. This is partly obtained by the relatively large bending radius R of the channel 31 near the free end, which radius is, for instance, 3.5 or even seven times or more the diameter D of the channel 31 ter plaatse.

In the use of a container according to the invention for carbonated beverage, in particular beer, it is preferred that the beverage is stored in the beverage container at an excess pressure relative to the surroundings which is, for instance, between 0.4 and 1.5 bar, for beer in particular about 0.7 bar. It has also been found that it is particularly advantageous when the beverage, in particular the beer, flows into a glass virtually pressureless, at least without excess pressure. With a beverage container according to the invention, the riser, the valve and the dispensing tube are therefore dimensioned and geared to each other, such that flow through the riser, valve and dispensing channel, respectively, involves a pressure drop between 0.4 and 1.5 bar, in particular approximately 0.7 bar, at least a pressure drop equal to the difference in pressure between the inner space of the container and the surroundings. Then, the pressure drop across the valve is relatively large, preferably at least half the total pressure drop, while the pressure drop across the dispensing channel is preferably smaller than the pressure drop across the valve, for instance 0.2 bar or less. It seems this offers the advantage that, possibly, the beverage in the dispensing channel can calm down to some extent when undesired foam formation should occur in the valve, for instance when some excess pressure prevails in the container. This is even further improved when the dispensing channel near the free end widens somewhat.

Figure 7:
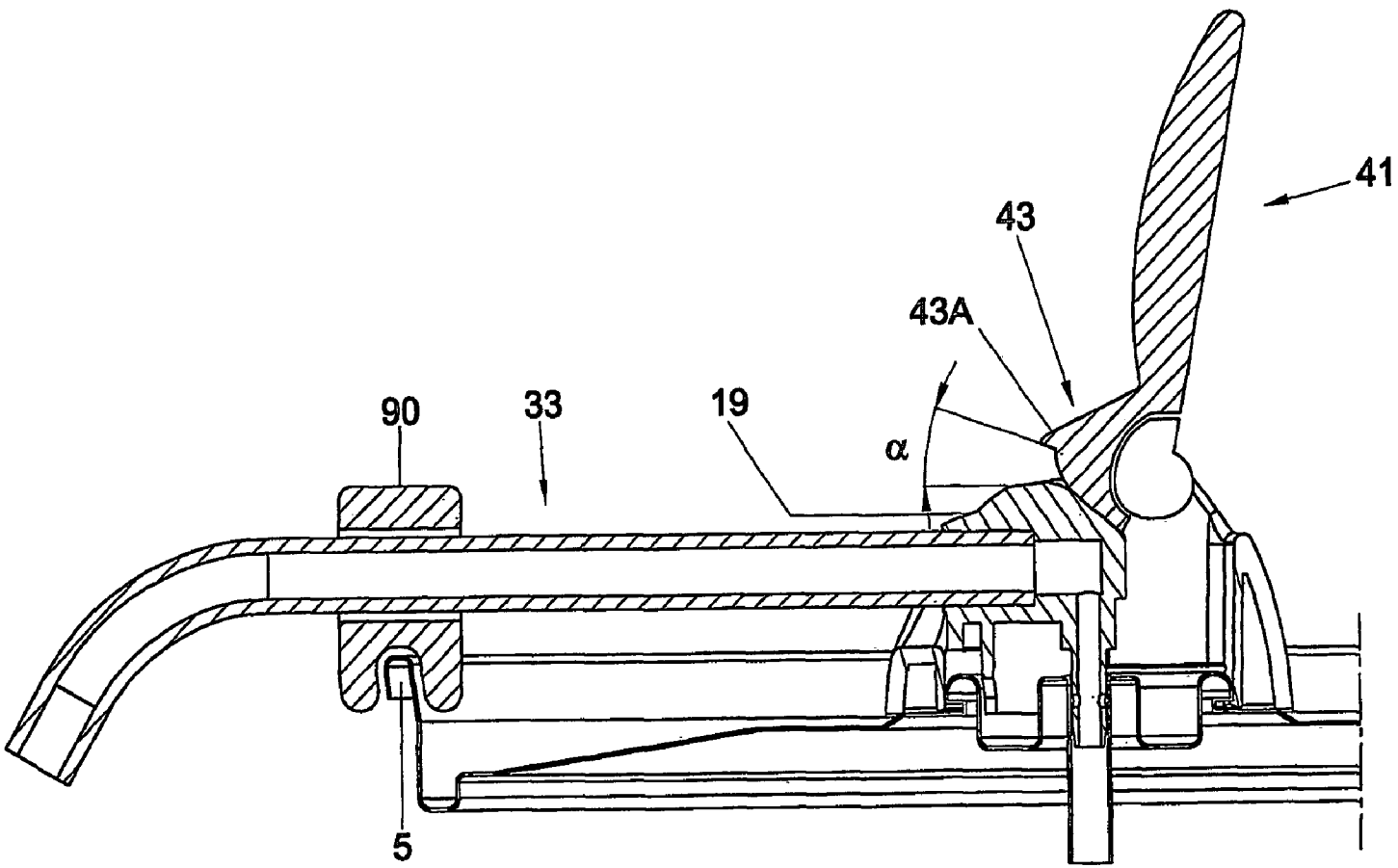
FIG. 7 shows, in cross sectional view, comparable to FIG. 6, an alternative embodiment of a lid with dispensing device for a container according to the invention.

In FIG. 7, an alternative embodiment of a container, at least a lid with dispensing device according to the invention is shown, in which the dispensing channel 33 is provided with a supporting element 90 resting on the peripheral edge 5 of the lid 2. In view of the relatively small axial movement of the stem 17 in proportion to the length of the dispensing channel between the supporting element 90 and the stem 17, the free end of the dispensing channel 33, in such an embodiment, will move relatively little, while the dispensing channel 38 is properly supported.

In this embodiment, the pivoting arm 41 is provided with a lower end 43 having a larger convexity than the pivoting arm shown in FIG. 6, a tooth 43A being provided which limits the pivotal movement of the pivoting arm 41 in the direction of the dispensing channel 33. The fact is that upon a pivotal movement through an angle greater than the angle γ in FIG. 7, the tooth 43 will contact the pressure body 19, so that further pivoting is prevented. In this position, the stem 17 is moved downwards maximally. However, as indicated hereinabove, the pivoting arm can be pivoted backwards, i.e. in the direction away from the dispensing channel 33 through an angle of approximately 90° or more, so that the pressure body 19 with the stem 17 can be detached from the valve and can be removed, together with the dispensing channel 33. Then, this can be cleaned separately and be reused. As described earlier, the housing 11 can also be detached.

Furthermore, an embodiment according to FIG. 7 is particularly suitable for use with a tilting valve, as the movement of the pressure body 19 can effect a tilting of the stem 17, so that such a tilting valve can be opened.

The invention is not in any way limited to the exemplary embodiments presented in the description and shown in the drawings. Many variations thereon are possible within the framework of the invention as outlined by the claims.

For instance, the pivoting arm and the housing may be designed in a different manner, the pivoting arm, for instance, being formed in one piece with the housing and being connected therewith by means of a living hinge. In the embodiment described, the different parts of the dispensing device are preferably manufactured from plastic, although also, for instance, metal parts may be used, for instance for the beverage dispensing channel or for the pivoting arm, with which both mechanical and esthetic advantages can be achieved. The valve 7 may be secured in the lid 2 in a different manner, while any type of valve, in particular the aerosol valve type, can be used within the invention. On, in particular, the somewhat convex surface of the pivoting arm 41 proximal to the beverage dispensing channel, advertising or other indications can be provided. Also, the pivoting arm can be designed to be partly transparent, wherein the advertising utterance mentioned can be provided on the rear side, for instance by in-mould labelling, a printing technique or the like. Naturally, the pivoting arm 41 may have any desired form and may be chosen, for instance, depending on the contents.

These and many comparable variations are understood to fall within the framework of the invention as outlined by the claims.

What is claimed is:

1. An apparatus for dispensing a beverage, comprising a housing provided with at least one connecting element for connecting to a container, and a pressure body, made as a separate part from said housing, movable relative to said housing and carrying a dispensing channel extending outside said housing, further comprising an operating arm which is pivotal around a pivotal axis connected to said housing and in a position of rest extending from said housing distanced from said at least one connecting element, wherein said pressure body is provided at least partly within said housing adjacent said pivoting arm, such that upon pivotal movement of said pivoting arm around said pivotal axis said pressure body is moved relative to said housing, said pressure body being removable from said apparatus for cleaning while said housing remains attached to said container and then being reinstallable in said apparatus.

2. An apparatus according to claim 1, further comprising a beverage container provided with a dispensing valve, said housing being connected to said container by said at least one connecting element, such that said pressure body is provided between said operating arm and said beverage valve and upon a pivotal movement of the arm from said position of rest, the pressure body is moved and the valve is opened by the pressure body.

3. An apparatus according to claim 2, wherein said operating arm includes, in said position of rest, an angle with a plane at right angles to a longitudinal axis of the dispensing valve.

4. An apparatus according to claim 3, wherein in the position of rest and the pivoting arm being in contact with the pressure body, the pivoting arm includes an angle between 45 and 135 degrees with said plane.

5. An apparatus according to claim 4, wherein said arm extends in said position of rest, substantially vertically.

6. An apparatus according to claim 1, wherein the arm, for opening the valve, can and must perform a pivotal movement in the direction directed towards the dispensing channel.

7. An apparatus according to claim 1, wherein the pressure body is detachable from the valve, such that it can be used with several beverage containers or can be cleaned separately from the beverage container.

8. An apparatus according to claim 1, wherein the pressure body is provided with a connecting means for coupling it to the valve, such that a channel in the pressure body on the one hand, is in fluid communication with a passage of the valve and, on the other hand, is or can be brought in fluid communication with the dispensing channel, wherein said housing is arranged at least partly over the pressure body, wherein the pivoting arm is pivotally connected to the housing part and has a pressure surface abutting the pressure body, at least during pushing down of the pressure body in or towards a position opening the valve.

9. An apparatus according to claim 8, wherein the pressure surface contains a bent lower face of the pivoting arm which abuts a top side of the pressure body, wherein the lower face is located other than concentrically relative to a pivot axis of the pivoting arm.

10. An apparatus according to claim 1, wherein in the container a pressure device is provided in which a pressure gas is received under excess pressure, wherein a control device is provided with which said pressure gas is dispensed into the container in a dosed manner, such that within the container a relatively constant excess pressure relative to the surroundings is maintained.

11. An apparatus according to claim 1, wherein the pivoting arm comprises an outer surface onto which recognition means are included for identification of the beverage received in the container.

12. An apparatus according to claim 1, wherein the valve comprises a stem provided with a connecting channel closed at a first end, wherein in the outer wall of the stem a number of passage openings are provided for forming a fluid communication of the connecting channel with the surroundings, wherein the passage opening or the passage openings jointly have a passage surface being approximately as large as or smaller than the passage surface of the connecting channel.

13. An apparatus according to claim 12, wherein between 2 and 4 passage openings are provided.

14. An apparatus according to claim 1, wherein upstream of the valve a riser is provided, wherein in the flow-path for the beverage, except from near and in the dispensing valve, only bends are included with a bending radius which is larger than at least twice the largest cross section of the passage surface at a respective bend.

15. An apparatus according to claim 14, wherein said bending radius is more than 3 times said largest cross section.

16. An apparatus according to claim 15, wherein the riser, the valve and the dispensing channel are dimensioned such that during use a pressure drop occurs there across between approximately 0.4 and 1.5 bar.

17. An apparatus according to claim 16, wherein across the valve at least approximately one-third of the pressure drop occurs.

18. An apparatus according to claim 16, wherein the pressure drop over the dispensing channel is between approximately 0.3 and 0.1 bar.

19. An apparatus according to claim 1, wherein the dispensing channel adjacent a free end thereof widens to some extent.

20. An apparatus according to claim 2, wherein the at least one connecting element is provided as clamping means with which the housing can be clamped onto a curled edge provided around the valve.

* * * * *